US006711980B2

(12) United States Patent
Kropf

(10) Patent No.: US 6,711,980 B2
(45) Date of Patent: Mar. 30, 2004

(54) ARMORED BOOTH

(76) Inventor: Omer G. Kropf, 1077 E. North Shore Dr., Syracuse, IN (US) 46567

( * ) Notice: Subject to any disclaimer, the term of this patent is extended or adjusted under 35 U.S.C. 154(b) by 0 days.

(21) Appl. No.: 10/150,357

(22) Filed: May 17, 2002

(65) Prior Publication Data

US 2003/0213359 A1 Nov. 20, 2003

(51) Int. Cl.[7] ..... F41H 7/00; F41H 13/00; F41H 5/14

(52) U.S. Cl. ..... 89/36.09; 89/36.07; 89/36.15

(58) Field of Search ..... 89/36.07, 36.08, 89/36.09, 36.15

(56) References Cited

U.S. PATENT DOCUMENTS

| | | | | | |
|---|---|---|---|---|---|
| 383,752 | A | * | 5/1888 | Milligan | 89/36.07 |
| 523,209 | A | | 7/1894 | Keely | |
| 1,083,846 | A | * | 1/1914 | Markson | 109/9 |
| 1,253,964 | A | * | 1/1918 | Hack | 52/143 |
| 1,489,281 | A | * | 4/1924 | Shaffer | 109/9 |
| 1,539,509 | A | | 5/1925 | Ring | |
| 1,667,543 | A | | 4/1928 | Fonagy | |
| 1,735,966 | A | | 11/1929 | Garver | |
| 1,744,279 | A | | 1/1930 | Neuendorf | |
| 1,799,970 | A | | 4/1931 | Goess | |
| 1,827,347 | A | | 10/1931 | Barota | |
| 1,875,488 | A | | 9/1932 | Peters | |
| 1,916,524 | A | | 7/1933 | Moore | |
| 2,209,654 | A | * | 7/1940 | Loeser, Jr. | 89/36.09 |
| 2,370,596 | A | * | 2/1945 | Wallace | 109/49.5 |
| 3,759,195 | A | | 9/1973 | Hitrys et al. | |
| 4,245,546 | A | * | 1/1981 | Chaires | 89/36 G |
| 4,509,301 | A | | 4/1985 | Head | |
| 4,677,896 | A | * | 7/1987 | Litvinoff | 89/36.08 |
| 4,781,101 | A | * | 11/1988 | Zevuluni et al. | 89/36.09 |
| 5,072,999 | A | | 12/1991 | Trotta et al. | |
| 6,435,071 | B1 | * | 8/2002 | Campbell | 89/36.08 |

* cited by examiner

*Primary Examiner*—Michael J. Carone
*Assistant Examiner*—H. A. Blackner
(74) *Attorney, Agent, or Firm*—Woodard Emhardt Moriarty McNett & Henry LLP

(57) ABSTRACT

An armored booth that functions as a protective enclosure permitting the occupants to approach armed individuals with reduced risk of harm to the occupants. The booth includes a housing formed of armored material and proportioned to be able to enter the doorway of a building. The housing has armored windows and gun ports. The housing has wheels and may be moved from place to place by the occupant walking inside of the housing.

12 Claims, 6 Drawing Sheets

ARMORED BOOTH

BACKGROUND OF THE INVENTION

1. Field of the Invention

This invention relates generally to an armored booth and more particularly to a protective enclosure that permits the occupants to approach armed individuals with reduced risk of harm to the occupants.

2. Description of the Relevant Art

In recent years, there have been frequent situations in which a school, place of business, home or residence is occupied or taken over by an armed individual or individuals, such as, a deranged student, disgruntled employee or unhappy lover. In many cases there are hostages involved. The police authorities are faced with a difficult problem. In order to obtain access to the premises and arrest the perpetrators, they must risk personal injury or death. Frequently the result is a standoff with the hope that the perpetrators will come to their senses and surrender and that any hostages will not be injured or killed. The desired outcome does not always happen, however, and it is therefore desirable that improved means be provided for aiding the police authorities in overcoming such perpetrators and rescuing any hostages.

There are available in the prior art various devices which might be used in such situations. For example, the U.S. Pat. No. 4,781,101 to Zevuluni discloses a mobile maneuverable crowd control shield within which a policeman can be protected and can move from place to place. The U.S. Pat. No. 4,245,546 to Chaires discloses a bulletproof or armored shield that protects the occupant and allows the occupant to move from place to place. The U.S. Pat. No. 1,253,964 to Hack discloses a guardhouse that is movable from place to place by the person inside the guardhouse who is protected by the guardhouse. These devices, however, are not completely satisfactory, in that they do not, for example, deal with the problem of the policeman entering a building or with the perpetrator shooting at the feet of the policeman as the policeman moves toward the perpetrator.

SUMMARY OF THE INVENTION

One embodiment of the armored booth of the present invention might involve a housing formed of armored material. The housing has walls having gun ports therein adapted to permit gun shooting through the gun ports from the interior of the housing. There are also provided windows formed of transparent armored material mounted in the walls. Wheels are mounted on the housing and are adapted to support the housing above a ground or floor surface. A flange is mounted on the housing so as to extend inwardly above at least a portion of the wheels whereby a person inside of the housing can stand on the flange to prevent gun shots from harming the feet of the person.

Another embodiment of the armored booth of the invention includes a housing formed of armored material. Wheels are mounted on the housing and are adapted to support the housing in spaced relation above a ground or floor surface. The housing has a transverse dimension that is less than 36 inches. The housing and wheels have a vertical dimension which is less than 82 inches whereby the housing is capable of passing through a rectangular building door opening of a dimension 36×82 inches or greater. The housing has walls having windows formed of armored glass the walls having gun ports therein adapted to permit gun shooting through the gun ports from the interior of the housing.

Still another embodiment of the invention is an armored booth including a housing formed of armored material. The housing includes walls which have gun ports therein adapted to permit gun shooting through the gun ports from the interior of the housing. Windows formed of transparent armored material are mounted in the walls. The walls include a rectangular front wall, a rectangular rear wall and two rectangular side walls. Wheels are mounted on the housing and are adapted to support the housing in spaced relation above a ground or floor surface. The front wall and housing have a horizontal dimension that is less than 36 inches. The housing and wheels have a vertical dimension that is less than 82 inches whereby the housing is capable of passing through a rectangular building door opening of dimensions 36×82 inches or greater. The front wall has a pair of arm openings therein. There is also provided a pair of armored closure members each having an upper edge that is pivotally attached to the front wall above a respective opening of said pair of arm openings. Each of the closure members is hung over a respective one of the arm openings and closes the respective arm opening but is pivotal outwardly away from the front wall to permit a person inside of the housing reaching his arm through a respective arm opening to open a door handle of a door in a building door opening whereby the armored booth may be moved through the building door opening.

Still a further embodiment of the armored booth involves a housing formed of armored material. The housing includes walls having gun ports therein adapted to permit gun shooting through the gun ports from the interior of the housing. Windows formed of transparent armored material are mounted in the walls. The walls include a rectangular front wall, a rectangular rear wall and two rectangular side walls. A first pair of wheels is mounted on the front wall and a second pair of wheels is mounted on the rear wall. The wheels are adapted to support the housing in spaced relation above a ground or floor surface. The first set of wheels is swivel mounted whereby the wheels can turn in multiple directions. The second pair of wheels is swivel mounted whereby the wheels can turn in multiple directions but also are restrainable so that they can turn only in a plane extending front to rear of said housing. Bearings are mounted on the rear wall and are movable to restrain the second pair of wheels to turn in only a front to rear extending plane relative to said housing.

Still a further embodiment of the invention is an armored booth comprising a housing formed of armored material. The housing includes walls having gun ports therein adapted to permit gun shooting through the gun ports from the interior of the housing. Windows formed of transparent armored material are mounted in the walls and wheels are mounted on the housing and adapted to support the housing above a ground or floor surface. The walls include a rear wall that has a door opening in the rear wall. A door formed of armored material is hung on the rear wall and is pivotal in a horizontal direction between a first position closing the door opening and a second position opening the door opening. Posts are mounted on the rear wall. The door is hung on the posts and is liftable off of the posts to serve as an armored shield.

Another embodiment of the invention is an armored booth comprising a housing formed of armored material. The housing has a wall with a window formed of transparent armored material mounted in the wall. The wall has a pair of arm openings therein. There is provided a pair of armored closure members each having an upper edge pivotally attached to the wall above a respective one of the arm openings and closing the respective arm opening but pivotal outwardly away from the front wall to permit a person inside the housing reaching his arm through the respective arm opening to open a door handle or a door in a building door opening whereby the armored booth may be moved through the building door opening.

Still a further embodiment of the invention involves providing a leveraged lift for lifting an armored housing over obstacles when the housing wheels are impeded.

DESCRIPTION OF THE PREFERRED EMBODIMENT

Figure 1:
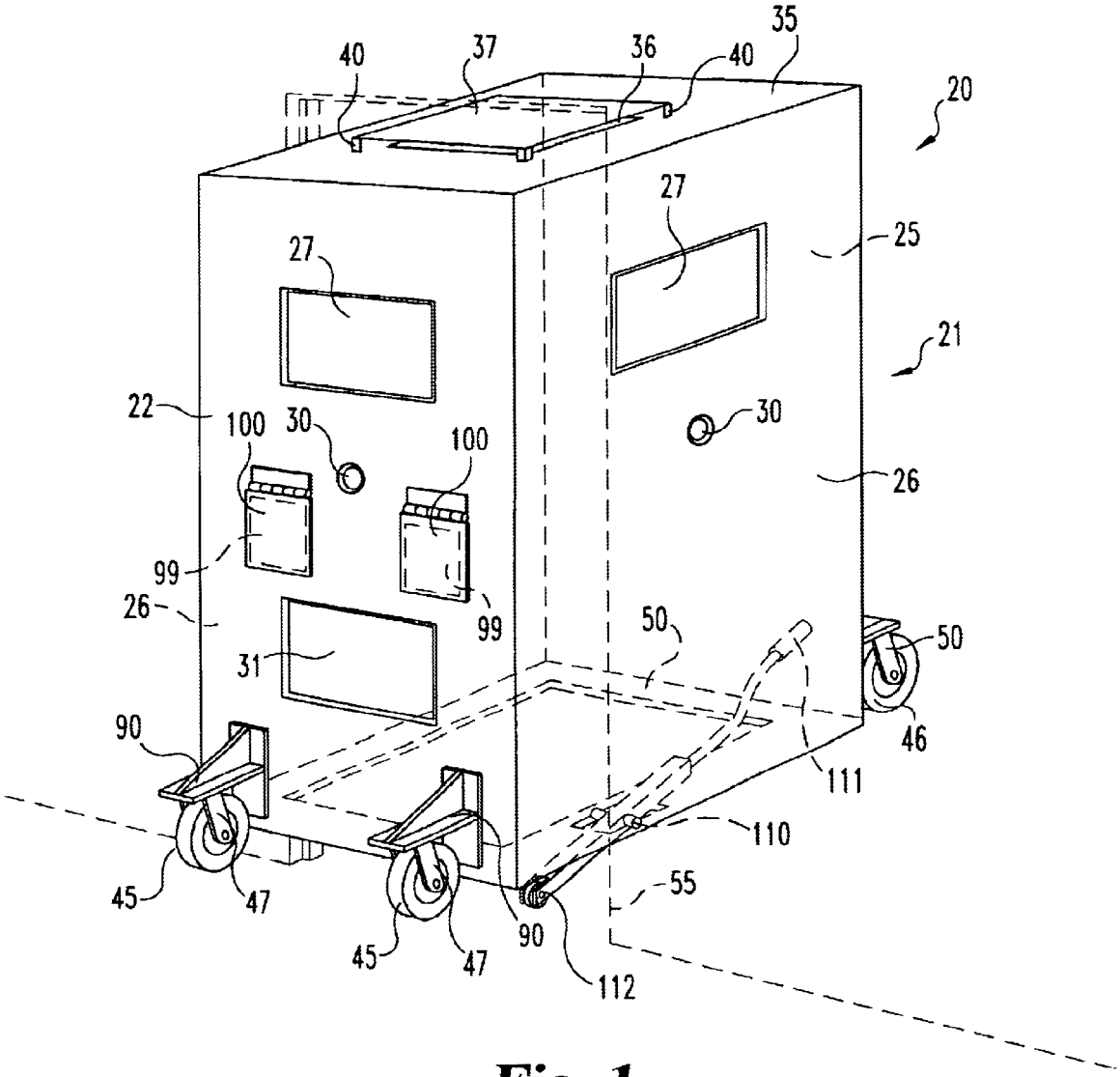
FIG. 1 is a perspective view of the armored booth of the present invention showing in dotted lines the booth entering a door opening in a building.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a preferred embodiment of an armored booth 20 which includes a housing 21 including a front wall 22, rear wall 25 and side walls 26. Each of the walls 22, 25 and 26 has a window 27 that is located at the normal height of the eyes of a person so that the occupant of the booth can see to shoot a gun through the gun port 30 located in each of the front and side walls of the armored booth. In the case of the front wall 22 there is an additional window 31 provided which allows the occupant of the armored booth to see what sort of obstacles might be in front of the armored booth as it is moved along the ground or floor. The windows 27 and 31 are formed of armored transparent material such as armored glass or the like. Also the walls 22, 25 and 26 are formed of armored material. One example of an appropriate material for the walls is ⅛" thick aluminum and Level 3 or 4 Kevlar fabricated by Supreme Corporation of Goshen, Ind. Level 3 or 4 refers to the commercial bullet resistant rating system known as UL 752 Edition 10 by Underwriters Laboratories.

The Kevlar fabric armored material may also be obtained commercially under the trade name Yellow Jacket. The armored glass is also available commercially from Protective Armored Systems of 140 Crystal Street, Lenox Dale, Mass. 01242. The gun ports may be merely openings or may be commercially available gun ports available, for example, from Supreme Corporation of P.O. Box 483, Goshen, Ind. 46627. Such gun ports can be closed with an armored closure so as to obstruct a bullet from coming into the booth from outside of the booth.

The housing also includes an armored top 35 that is rectangular and has a rectangular ventilation opening 36 in the center of the top. Mounted directly above and completely covering the ventilation opening 36 is an armored member 37 secured to the top 35 by four spacers 40 located at the corners of the member 37. The top 35 and member 37 are formed of the same armored material as the walls 22, 25 and 26.

The armored booth has a first pair of wheels 45 mounted on the front of the booth and a second pair of wheels 46 mounted on the rear of the booth. The wheels in a preferred embodiment of the invention have a diameter of eight inches which allows them to roll over bumps in the ground or floor surface. The wheels 45 and 46 are swivel mounted by mounting members 47 and 50. The wheels 45 and 46 support the housing in spaced relation above the ground or floor surface. It is preferred that this spacing be approximately two inches although the booth is usable with spacings less than and greater than two inches. The housing 21 has a flange 50 mounted on the housing and specifically on the rear, front and side walls of the housing. The flange extends inwardly above the wheels and allows a person inside the housing to stand on the flange so as to prevent gun shots from harming the feet of the person.

FIG. 1 also shows in dotted lines the entryway or door opening 55 of a building. The armored booth of the present invention is intended to be able to go through a door opening of a building. Typical door openings have dimensions that are 36×82 inches. Therefore the vertical height of the housing 21 and the wheels which support the housing off the ground or floor surface should be less than 82 inches. Also the transverse dimension of the housing is less than 36 inches, which is the typical transverse dimension of a door opening in a building.

Figure 2:
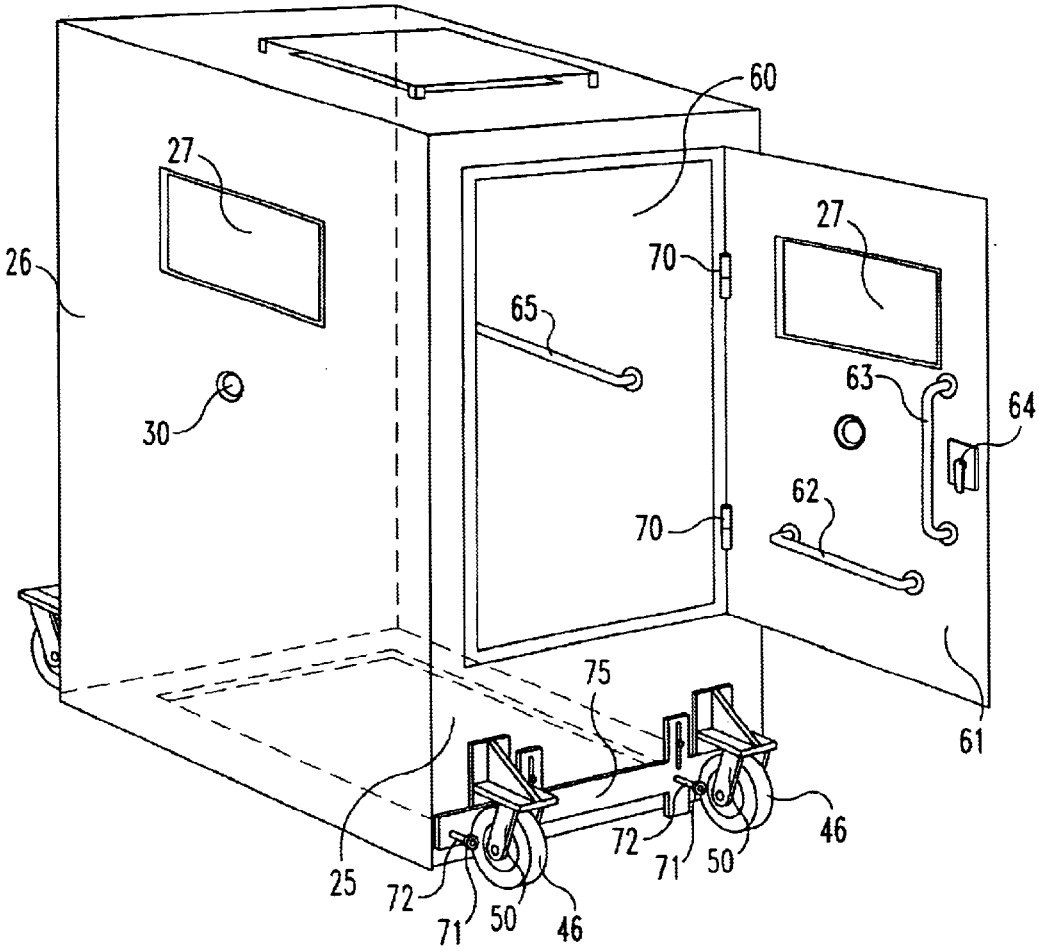
FIG. 2 is a perspective view of the armored booth looking toward the rear of the booth.

Referring to FIG. 2 the rear of the armored booth is illustrated in more detail and includes the rear wall 25. The housing has a door opening 60 in the rear wall 25. The door opening 60 is closed by the housing door 61 which is formed of armored material and is hung on the rear wall and is pivotal in a horizontal direction between a first position closing the housing door opening and a second position illustrated in FIG. 2 opening the housing door opening 60. The door 61 has a latch 64. FIG. 2 also shows handles 62, 63 and 65. The handles 62 and 63 are mounted on the housing door 61 and used to lift the door 61 off of the posts 66 shown in FIG. 3. The posts 66 are mounted on the rear wall 25 and project upwardly and are normally received within the sockets 70 mounted on the rear door 61. When the rear door 61 is removed as in FIG. 3 it can be used as an armored shield. Also as illustrated the rear door 61 has an armored transparent window 27 and gun port 30 that is available to the user of the shield and door 61. The door 61 may be formed of the same armored material used for the walls 22, 25 and 26.

As described above the rear wheels 46 are swivel mounted by mounting members 50. The rear wheels 46 however may be restrained in a plane extending front to rear of the housing by means of bearings 71 which are mounted on shafts 72. The shafts 72 are fixed in and project from a bar 75. The bar may be latched in an upward position which causes the bearings to be moved away from the wheels 46 so that they are free to swivel. When the bar 75 is not latched in the upward position it may be moved down to the illustrated position of FIG. 2 whereby the wheels 46 are restrained by the bearings 71 so that they can only turn in a plane front to rear of the housing. It is normally easier to move the housing from place to place with the rear wheels 46 restrained in the front to rear plane and with the front wheels in a swiveling condition. However, if it is desired to rotate the armored booth in place it is preferred to allow the rear wheels to swivel.

Figure 6:
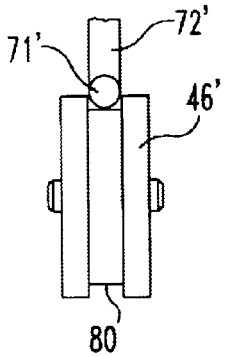
FIG. 6 is a fragmentary view of an alternative wheel arrangement of the present invention.
Figure 8:
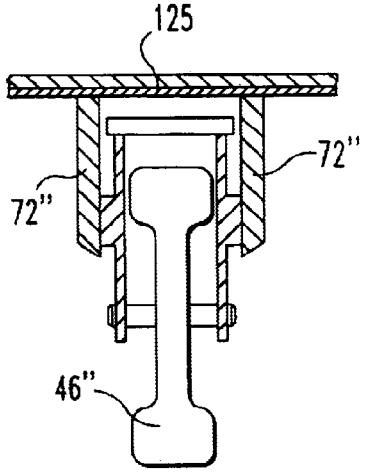
FIG. 8 is a fragmentary view of an alternative wheel arrangement of the present invention.
Figure 7:
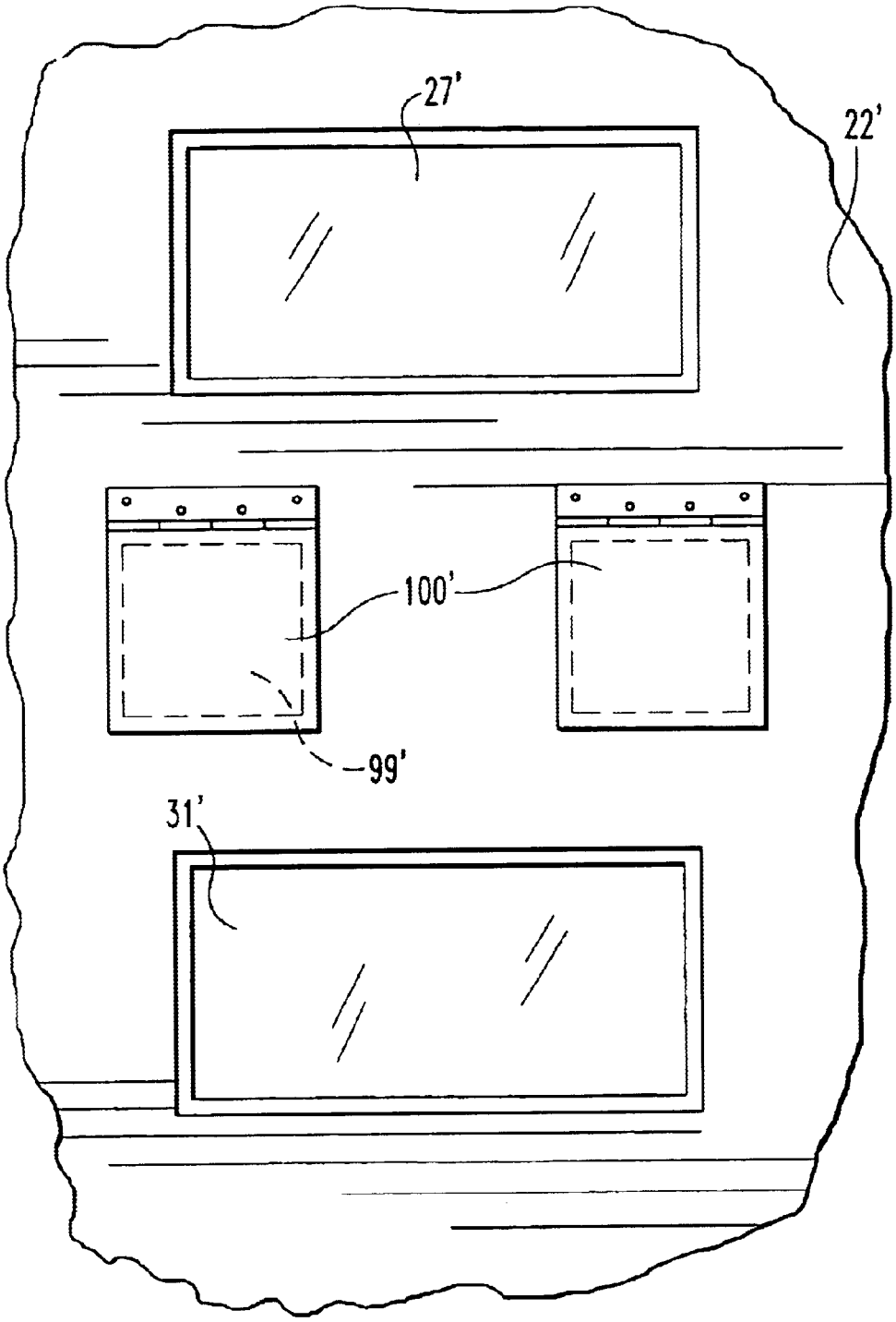
FIG. 7 is a fragmentary view of an alternative armored booth of the present invention.

Referring to FIG. 6 an alternative embodiment of the invention includes having a peripheral slot 80 surrounding each rear wheel 46' and the projection 72' being only a single projection instead of a projection on either side of the wheel so that the projection 72' has a bearing 71' on its distal end. The arrangement illustrated in FIG. 6 operates in the same fashion as the embodiment illustrated in FIG. 2 to restrain the wheels 46' in a plane extending front to rear of the housing. Still another alternative embodiment is shown in FIG. 8 wherein the wheel 46" may be restrained in a plane extending front to rear of the housing by projecting flat members 72" which are mounted on a plate 125 that is horizontally slidably mounted on the rear wall of an armored booth.

Figure 5:
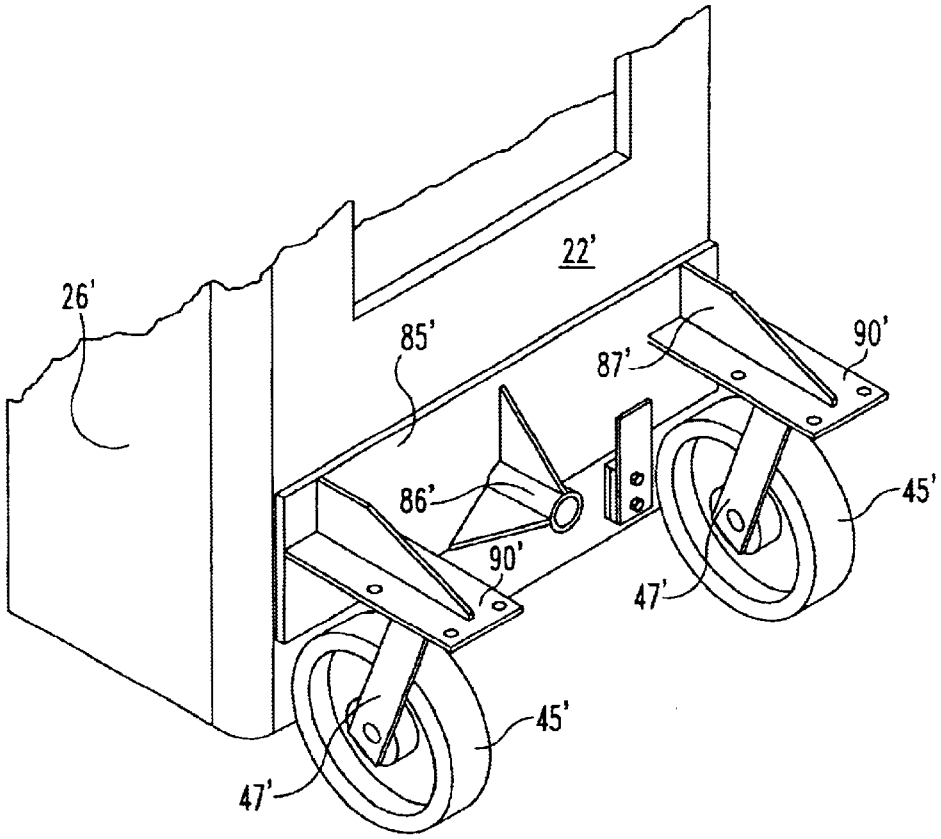
FIG. 5 is a fragmentary perspective view similar to FIG. 1 of an alternative embodiment of the armored booth of the present invention.

Referring to FIG. 5, there is shown an alternative embodiment wherein the front wheels 45' are mounted on a plate 85' pivotally mounted at the center 86' of the plate to the front wall 22'. The wheel mounting members 90' to which the wheels 45' are swivel mounted by the swivel members 47' are secured to the opposite ends 871 of the plate 85'. Thus if the housing encounters a bump that raises one of the wheels 45' relative to the other wheel 45', the plate 85' pivots about the axis of mounting 86' so that it is easier to move the housing from place to place.

Figure 4:
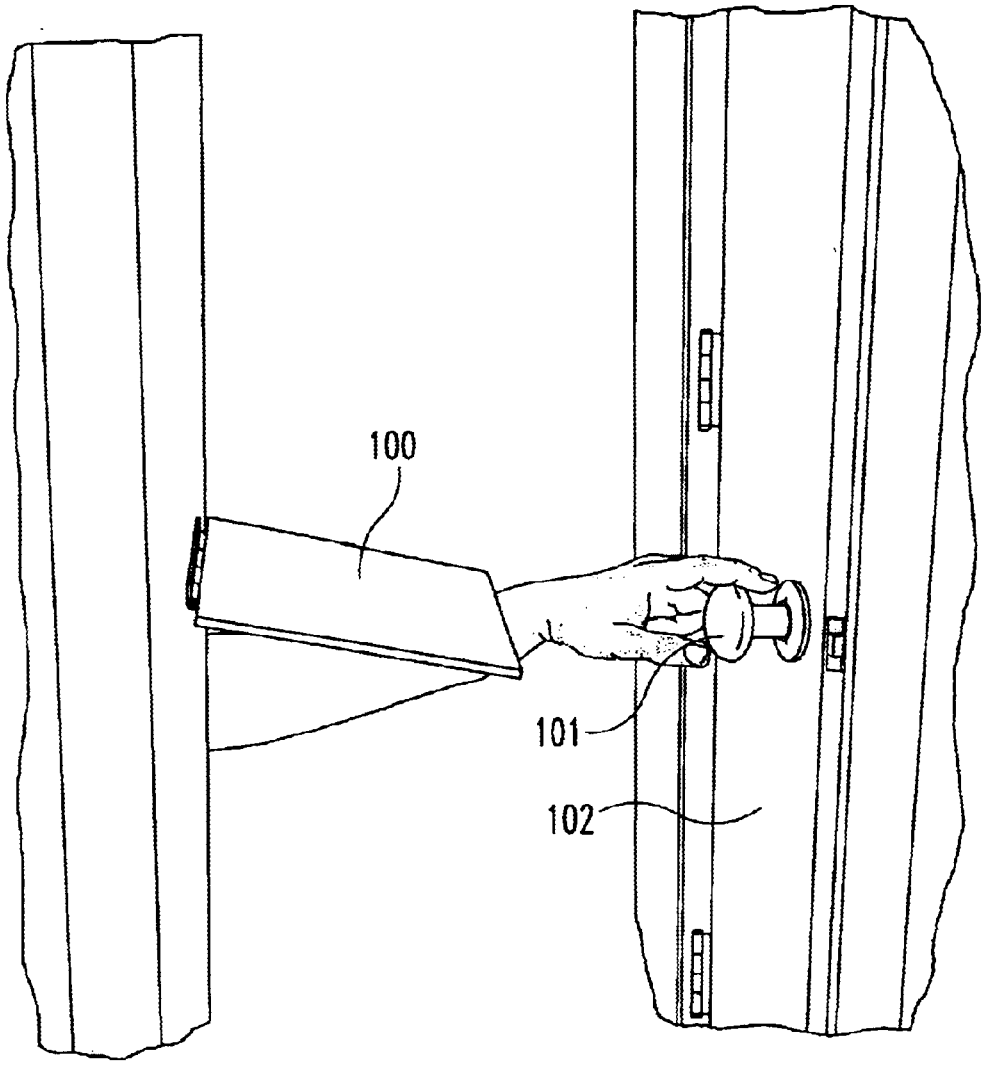
FIG. 4 is a perspective view of the front of the armored booth of FIG. 1 showing one of the steps in opening the door of a building.

Referring to FIGS. 1 and 4, the front wall 22 has a pair of arm openings 99 therein each of which is covered by a respective armored closure member 100. Each of the closure members 100 has an upper edge which is pivotally attached to the front wall 22 above a respective one of the openings. Each of the closure members can be swung away from the front wall to permit a person inside the housing reaching his arm through a respective opening to open a door handle 101 of a door 102 in a building door opening such as the door opening 55 of FIG. 1. Two arm openings 99 are provided one on each side of the armored booth 20 so that a door handle on either side of the building door can be opened.

When in use the armored booth may be impeded by a large bump, step up or other variation from flat surface over which the armored booth is moved. A leveraged lift 110 is provided to clear such obstacles. The leveraged lift is pivotally mounted on the housing and the lever arms 111 and 112 are suitably proportioned to ease lifting the housing over the obstacle. This feature may or may not be provided in the embodiment of FIGS. 1–7. Also this feature may be provided in wheeled armored booths having housing of other shapes and sizes than described in connection with FIGS. 1–6. Alternatively two of the leveraged lifts 110 may be provided, one on each of the two sides of the housing. The two leveraged lifts may be used independently or both may be used at the same time to lift the front two wheels 45 over an obstacle blocking both wheels.

While the invention has been illustrated and described in detail in the drawings and foregoing description, the same is to be considered as illustrative and not restrictive in character, it being understood that only some of the preferred embodiments have been shown and described and that all changes and modifications that come within the spirit of the invention are desired to be protected.

Figure 3:
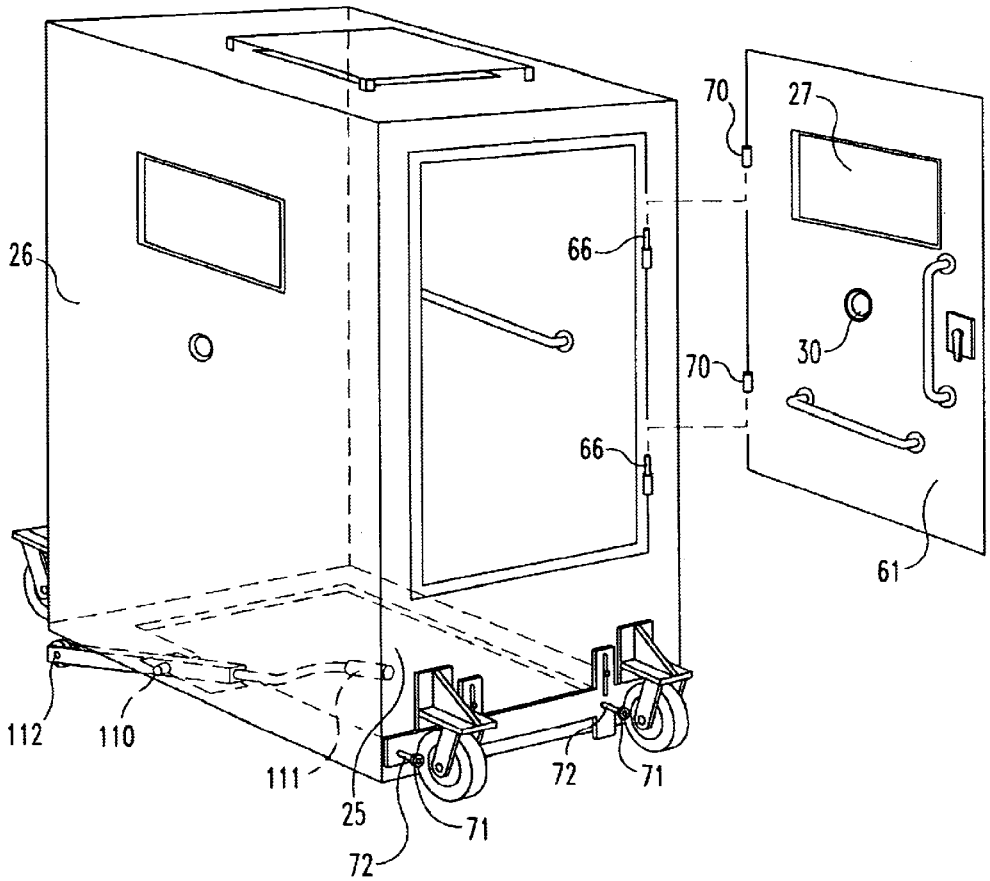
FIG. 3 is a view similar to FIG. 2 showing the rear door of the armored booth removed.

As examples of some of the other embodiments of the invention that are desired to be protected, the armored booth might have an outside housing configuration other than the rectangular configuration of FIGS. 1–3 and might have the configuration for example as shown in the Zevuluni patent 4,781,101. Alternatively, the outside housing configuration might be as shown in the Chaires patent 4,245,546 but with the modification that wheels such as 45 or 45' and 46 would be provided and mounted on the housing or shield of the Chaires patent to support the housing in spaced relation to the ground or floor as described and shown above in connection with the preferred embodiment of FIGS. 1–3. Each of these other embodiments of this paragraph would be provided with the flange 50 mounted on the housing at the lower edge thereof so as to allow the person inside the housing to stand on the flange so as to prevent gun shots from harming the feet of the person.

Still other embodiments of the invention desired to be protected involve use of an outside housing configuration other than the rectangular configuration of FIGS. 1–3 and also eliminating the wheels 45 and 46. Such an alternative embodiment is shown fragmentarily in FIG. 7 as having the doors 100', arm openings 99' and armored windows 27' and 31' in the wall 22'.

Still further embodiments of the invention include providing an armored housing of any configuration and dimensions for the housing but having the above-described wheel system. Specifically the housing is provided with front wheels 45 which are swivel mounted. The housing also has rear wheels 46 which are also swivel mounted but are also restrainable so that they turn only in a plane extending front to rear of the housing. These embodiments are also provided with bearings mounted on the housing and movable to restrain the rear wheels to turn only in a front to rear extending plane relative to said housing.

What is claimed:

1. An armored booth comprising a housing formed of armored material, said housing including walls having gun ports therein adapted to permit gun shooting through said gun ports from the interior of said housing, windows formed of transparent armored material mounted in said walls, said walls including a rectangular front wall, a rectangular rear wall and two rectangular side walls, wheels mounted on said housing and adapted to support the housing in spaced relation above a ground or floor surface, said front wall and housing having a horizontal dimension less than thirty-six inches and said wheels and housing having a vertical dimension less than eighty-two inches whereby the housing is capable of passing through a rectangular building door opening of dimensions thirty-six by eighty-two inches or greater, said front wall having a pair of arm openings therein, a pair of armored closure members each having an upper edge which is pivotally attached to said front wall above a respective one of said arm openings, each of said closure members being hung over a respective one of said openings and closing the respective arm opening but pivotal outwardly away from the front wall to permit a person inside the housing reaching his arm through a respective arm opening to open a door handle of a door in a building door opening whereby the armored booth may be moved through the building door opening.

2. The armored booth of claim 1 additionally comprising a flange mounted on said housing and extending inwardly above said wheels whereby a person inside of said housing can stand on said flange to prevent gun shots from harming the feet of the person.

3. The armored booth of claim 2 wherein said wheels include a first pair of wheels mounted on said front wall and a second pair of wheels mounted on said rear wall, said first pair of wheels being swivel mounted whereby the wheels can turn in multiple directions, said second pair of wheels being swivel mounted whereby the wheels can turn in multiple directions but also being restrainable so that they turn only in a plane extending front to rear of said housing.

4. The armored booth of claim 3 additionally comprising a housing door opening in said rear wall, a housing door formed of armored material and hung on said rear wall and pivotal in a horizontal direction between a first position closing said housing door opening and a second position opening said housing door opening, posts mounted on said rear wall, said door being hung on said posts and liftable off of said posts to serve as a armored shield.

5. An armored booth comprising a housing formed of armored material, said housing including walls having gun ports therein adapted to permit gun shooting through said gun ports from the interior of said housing, windows formed of transparent armored material mounted in said walls, said walls including a rectangular front wall, a rectangular rear wall and two rectangular side walls, a first pair of wheels mounted on said front wall, a second pair of wheels mounted on said rear wall, said wheels being adapted to support the housing in spaced relation above a ground or floor surface, said first pair of wheels being swivel mounted whereby the wheels can turn in multiple directions, said second pair of wheels being swivel mounted whereby the wheels can turn in multiple directions but also being restrainable so that they turn only in a plane extending front to rear of said housing, and bearings mounted on said rear wall and movable to restrain said second pair of wheels to turn in only a front to rear extending plane relative to said housing.

6. The armored booth of claim 5 additionally comprising a flange mounted on said housing and extending inwardly above said wheels whereby a person inside of said housing can stand on said flange to prevent gun shots from harming the feet of the person.

7. The armored booth of claim 6 wherein said front wall has a pair of arm openings therein, a pair of armored closure members each having an upper edge which is pivotally attached to said front wall above a respective one of said arm openings, each of said closure members being hung over a respective one of said arm openings and closing the respective arm opening but pivotal outwardly away from the front wall to permit a person inside the housing reaching his arm through the respective arm opening to open a door handle of a door in a building door opening whereby the armored booth may be moved through the building door opening.

8. The armored booth of claim 7 additionally comprising a housing door opening in said rear wall, a housing door formed of armored material and hung on said rear wall and pivotal in a horizontal direction between a first position closing said housing door opening and a second position opening said housing door opening, posts mounted on said rear wall, said door being hung on said posts and liftable off of said posts to serve as a armored shield.

9. The armored booth of claim 8 wherein said housing additionally includes a rectangular top which is secured to said front, rear and side walls, said top being formed of armored material and having a rectangular top opening therein arranged to permit ventilation of said housing, and a armored cover for said rectangular top opening mounted on said rectangular top.

10. The armored booth of claim 8 wherein said windows include one window above said arm openings in said front wall and a second window below said arm openings, whereby a person inside of said housing can see in a straight ahead direction and also in a downwardly viewing direction.

11. The armored booth of claim 5 additionally comprising a member pivotally mounted on said front wall, said first pair of wheels being mounted on said member whereby said first pair of wheels can more easily move over uneven ground.

12. The armored booth of claim 8 additionally comprising a window formed of transparent armored material mounted in said door and said door having a gun port therein adapted to permit gun shooting from behind said door.

* * * * *

UNITED STATES PATENT AND TRADEMARK OFFICE

CERTIFICATE OF CORRECTION

PATENT NO. : 6,711,980 B2
DATED : March 30, 2004
INVENTOR(S) : Omer G. Kropf

It is certified that error appears in the above-identified patent and that said Letters Patent is hereby corrected as shown below:

Column 5,
Line 33, please change “871” to -- 87’ --.

Signed and Sealed this

Twenty-fifth Day of May, 2004

JON W. DUDAS
*Acting Director of the United States Patent and Trademark Office*